US007987748B2

(12) United States Patent
Chiu

(10) Patent No.: US 7,987,748 B2
(45) Date of Patent: Aug. 2, 2011

(54) IDENTIFICATION STRUCTURE OF A TOOL WITH TWO COLORS

(76) Inventor: Kuo Tung Chiu, Wurih Township, Taiohung County (TW)

( * ) Notice: Subject to any disclaimer, the term of this patent is extended or adjusted under 35 U.S.C. 154(b) by 434 days.

(21) Appl. No.: 11/641,658

(22) Filed: Dec. 20, 2006

(65) Prior Publication Data

US 2008/0148910 A1 Jun. 26, 2008

(51) Int. Cl.
*B25B 13/00* (2006.01)

(52) U.S. Cl. ..... 81/121.1; 81/119; 81/DIG. 5

(58) Field of Classification Search ..... 81/180.1, 81/124.3, 58.1, 124, 124.1, 125, 121.1, 488, 81/489, DIG. 5
See application file for complete search history.

(56) References Cited

U.S. PATENT DOCUMENTS 4,417,488 A * 11/1983 Gentry ..... 81/185
4,982,627 A * 1/1991 Johnson ..... 81/121.1
5,009,133 A * 4/1991 Carey ..... 81/180.1
5,330,230 A * 7/1994 Craig ..... 283/81
5,819,606 A * 10/1998 Arnold ..... 81/124.3
5,957,012 A * 9/1999 McCune ..... 81/180.1
6,185,771 B1 * 2/2001 Trusty, Sr. ..... 7/128
6,792,831 B2 * 9/2004 Crosser ..... 81/119
7,028,588 B2 * 4/2006 Shih ..... 81/121.1
7,104,167 B2 * 9/2006 Babij, Jr. ..... 81/434
7,117,765 B1 * 10/2006 Wallden ..... 81/60
7,159,491 B1 * 1/2007 Chaconas et al. ..... 81/58.1
2005/0193874 A1 * 9/2005 Shih ..... 81/121.1
2006/0266163 A1 * 11/2006 Crosser ..... 81/119

* cited by examiner

*Primary Examiner* — David B Thomas
(74) *Attorney, Agent, or Firm* — James A. Italia; Italia IP

(57) ABSTRACT

An identification structure of a tool with two colors includes a tool body having an engaging surface, and an identification ring. The identification ring is made of elastic polymer, composed of an inner layer and an outer layer having diverse colors. The identification ring is mounted around the engaging surface of the tool body, having the outer layer fitted in an intermediate portion of the inner layer to make an upper and a lower edge of the inner layer extending outside the outer layer. So, the two edges of the inner layer have the same color and the intermediate portion of the identification ring has two different colors, keeping them apt to be recognized.

17 Claims, 6 Drawing Sheets

IDENTIFICATION STRUCTURE OF A TOOL WITH TWO COLORS

BACKGROUND OF THE INVENTION

1. Field of the Invention

This invention relates to an identification structure of a tool, particularly to one provided with an engaging surface for mounting with two layers having different colors for clear recognition.

2. Description of the Prior Art

Commonly, as shown in FIG. 1, a conventional identification structure of a tool consists of a sleeve 10 and an engaging ring 20. The sleeve 10 is provided with a big waist portion 11 located in its intermediate portion, having an anti-slipping slot 111 formed on its outer surface, and an annular groove 12 cut above the big waist portion 11 for correspondingly engaging with the engaging ring 20. The engaging ring 20 is made of plastics, which, shaped annular, is provided with a number mark portion 21 formed on its surface for indicating measurements. So, the engaging ring 20 is to be engaged in the annular groove 12 of the sleeve 10, rotatable to let the sleeve 10 identify the measurements. But, the engaging ring 20 is always apt to rotate unexpectedly because it is made of plastics, having a glassy surface that has little friction while contacting with the sleeve 10. And, the engaging ring 20 is apt to deform after using for a period of time, to easily come off the sleeve 10. Although the sleeve 10 is printed with a single color on its surface by some manufacturers (not shown in the figure), the single color is actually not apparent enough and may come off to pose inconvenience during operation. Moreover, though the number mark portion 21 is carved with projected characters, but it cannot be clearly and quickly identified by a user owing to the single color used only.

SUMMARY OF THE INVENTION

The objective of this invention is to offer an identification structure of a tool with two colors.

The main characteristics of the invention are a tool body having an engaging surface, and an identification ring. The identification ring is made of elastic polymer, composed of an inner layer and an outer layer having diverse colors. The identification ring is mounted around the engaging surface of the tool body, having the outer layer fitted in an intermediate portion of the inner layer to make an upper and a lower edge of the inner layer extending outside the outer layer. So, the two edges of the inner layer have the same color and the intermediate portion of the identification ring has two different colors, keeping them apt to be recognized. In addition, the polymer has a high friction able to keep the inner layer and the outer layer from rotating unexpectedly and coming off the tool body. The colors of the inner layer and the outer layer are not to disappear because they are not printed on but derived from the polymer.

BRIEF DESCRIPTION OF DRAWINGS

This invention is better understood by referring to the accompanying drawings, wherein.

DETAILED DESCRIPTION OF THE PREFERRED EMBODIMENT

Figure 1:
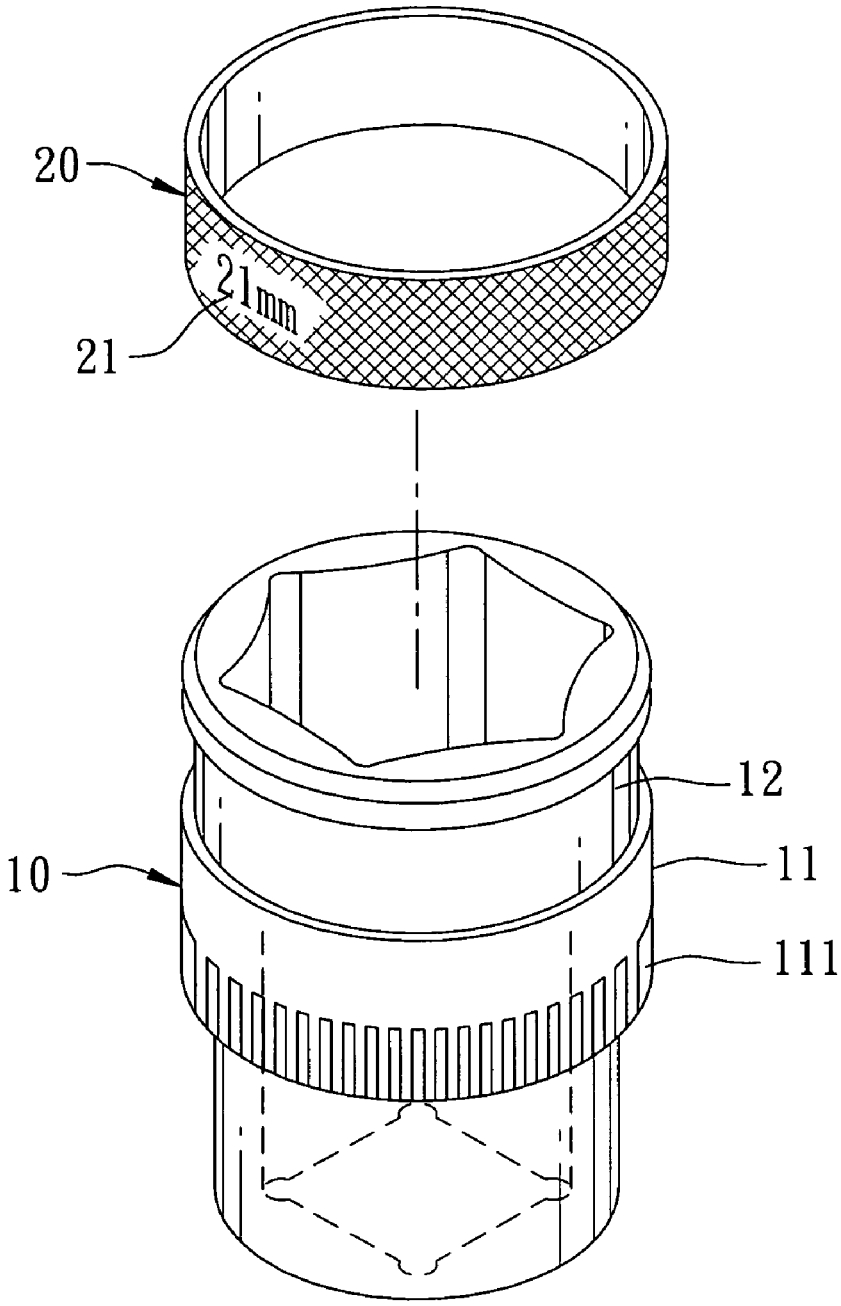
FIG. 1 PRIOR ART
FIG. 1 is an exploded perspective view of a conventional identification structure of a tool.
Figure 2:
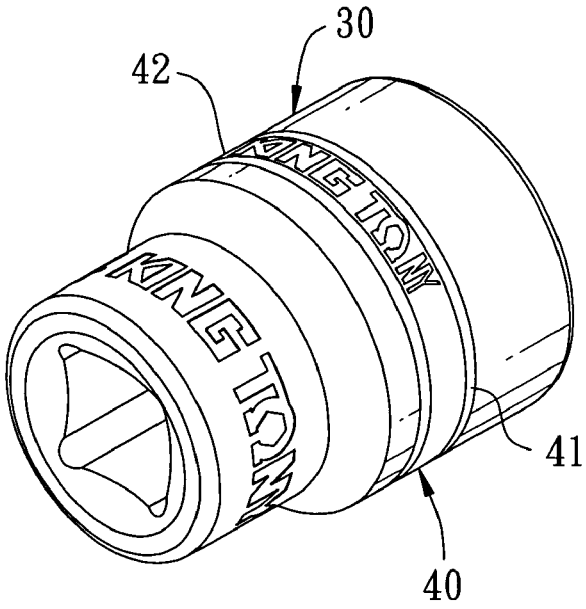
FIG. 2 is a perspective view of a first preferred embodiment of an identification structure of a tool with two colors in the present invention.
Figure 3:
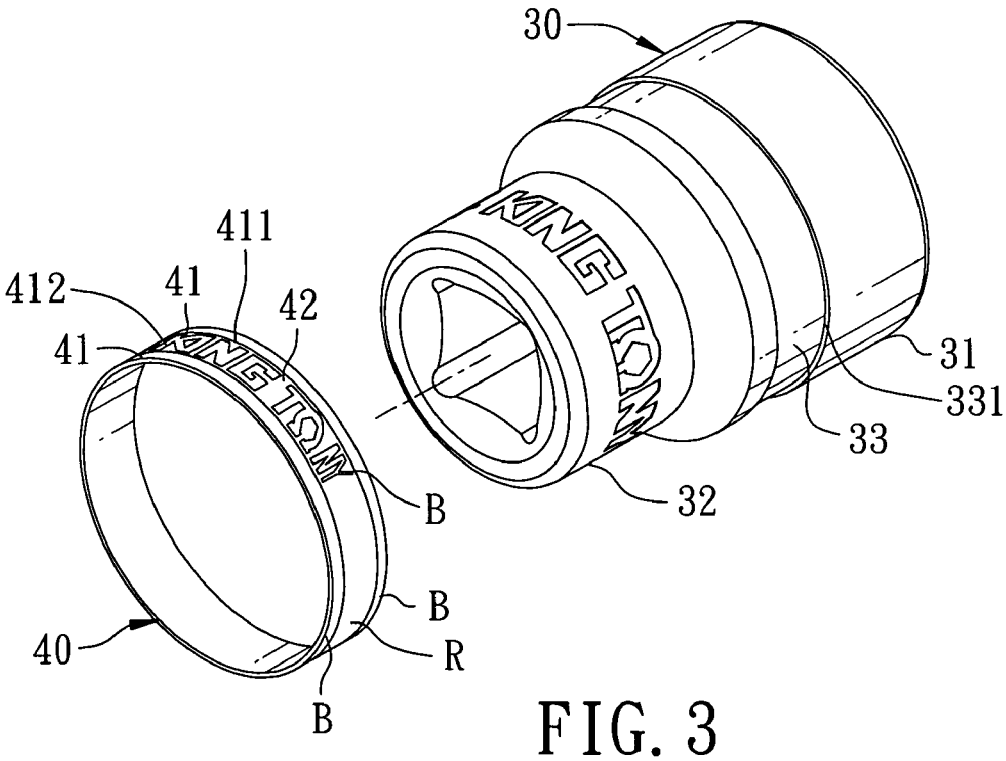
FIG. 3 is an exploded perspective view of the first preferred embodiment of an identification structure of a tool with two colors in the present invention.
Figure 4:
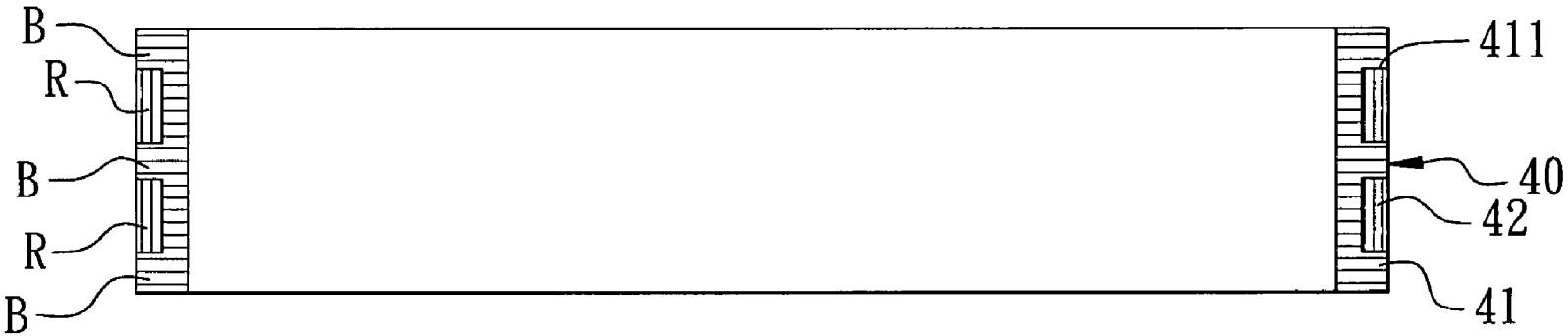
FIG. 4 is a cross-sectional view of the first preferred embodiment of an identification structure of a tool with two colors in the present invention.

As shown in FIGS. 2~4, a first preferred embodiment of an identification structure of a tool with two colors in the present invention consists of a tool body 30 and an identification ring 40.

The tool body 30 formed as a sleeve is provided with a large waist portion 31 formed at its lower portion, a small waist portion 32 formed at its upper portion, an engaging surface 33 located around some annular portion of the large waist portion 31, and an annular groove 331 cut in the engaging surface 33.

The identification ring 40 is formed elastic with some constricting force, provided with an inner layer 41 and an outer layer 42. The inner layer 41 is made of elastic high molecular polymer with a higher rigidity and the outer layer 42 is made of that with a lower rigidity. The polymers include TPR, TPE, TPU, silicon rubber, rubber and plastics having a high thermal resistance. The inner layer 41 and the outer layer 42 are formed integrally. The inner layer 41 is provided with an annular groove 411 formed around its intermediate portion, and a marking portion 412 projected in the annular groove 411, including characters, symbols and drawings. The inner layer 41 is then put in a mold (not shown in figures) to fill the annular groove 411 with the polymer to form as the outer layer 42, so that the outer layer 42 is combined together with the inner layer 41. And, the inner layer 41 has a color different from that of the outer layer 42, so that the outer layer 42 can be easily distinguished from the inner layer 41 after combined together. That is, the inner layer 41 is blue and the outer layer 42 is red. Or they can be other two diverse colors.

As shown in FIGS. 3 and 4, the identification ring 40 is correspondingly mounted around the engaging surface 33 of the tool body 30. The outer layer 42 is correspondingly installed in the annular groove 411 of the inner layer 41, keeping an upper and a lower edge of the inner layer 41 extending outside the outer layer 42 with the same color, blue. By the time, the red color of the outer layer 42 is surrounded by the blue color of the edge of the inner layer 41. What's more, the marking portion 412 has the same blue color as the inner layer 41 does, keeping the marking portion 412 apt to be immediately recognized owing to its blue color surrounded by the red color of the outer layer 42. In addition, as the identification ring 40 is elastic, it is easy to mount on the annular groove 331. And, both the inner layer 41 and the outer layer 42 have a great friction on their surfaces because they are made of elastic polymer, keeping the inner layer 41 mounted around the tool body 30 almost immovably. Also, the inner layer 41 and the outer layer 42 are to deform so slightly that they are not to come off the annular groove 411 or the annular groove 331 easily. Owing to the different colors of the inner layer 41 and the outer layer 42, the identification ring 40 provides a clear marking portion for the tool body 30 to identify measurements, specification, metric system or imperial system etc.

Figure 5:
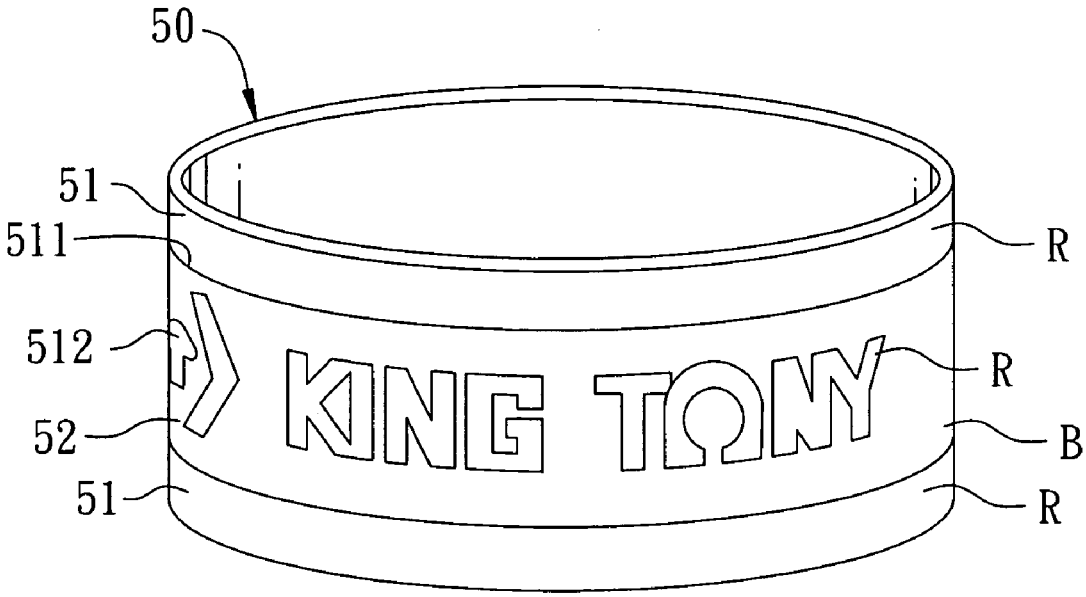
FIG. 5 is a perspective view of an identification ring of a second preferred embodiment of an identification structure of a tool with two colors in the present invention.

As shown in FIG. 5, a second preferred embodiment of an identification structure of a tool with two colors in the present invention has the same components as the first one does, except that the identification ring 40 in the first embodiment is replaced with another identification ring 50. The identification ring 50 is provided with an inner layer 51 and an outer layer 52. The inner layer 51 has a color different from that of the outer layer 52, so that the inner layer 51 and the outer layer 52 can be clearly distinguished. The inner layer 51 is red and the outer layer 52 is blue. Or they can be other two diverse colors.

Figure 6:
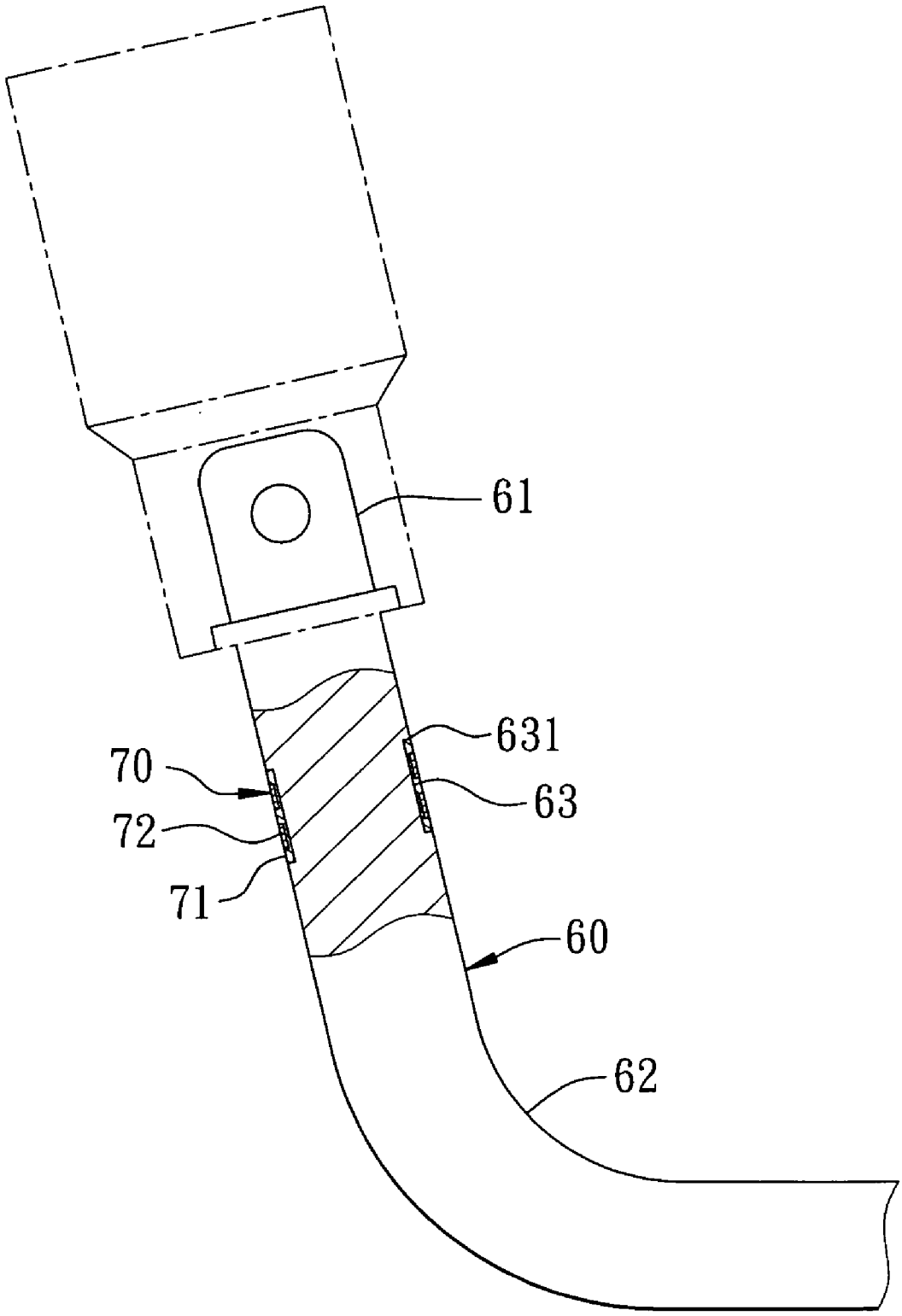
FIG. 6 is a side view of a third preferred embodiment of an identification structure of a tool with two colors in the present invention.

As shown in FIG. 6, a third preferred embodiment of an identification structure of a tool with two colors in the present invention has the same components as the first one does. The tool body 60 is a flex wrench provided with a working head 61 formed at its front portion for pivotally connecting with a tool. The tool body 60 is also provided with a grip 62 and a engaging surface 63 located in some annular portion of the grip 62, provided with an annular groove 631 concaved on its surface. The identification ring 70 is composed of an inner layer 71 and an outer layer 72, made in different colors and overlapped mutually in the annular groove 631 for achieving good distinguishing.

Figure 7:
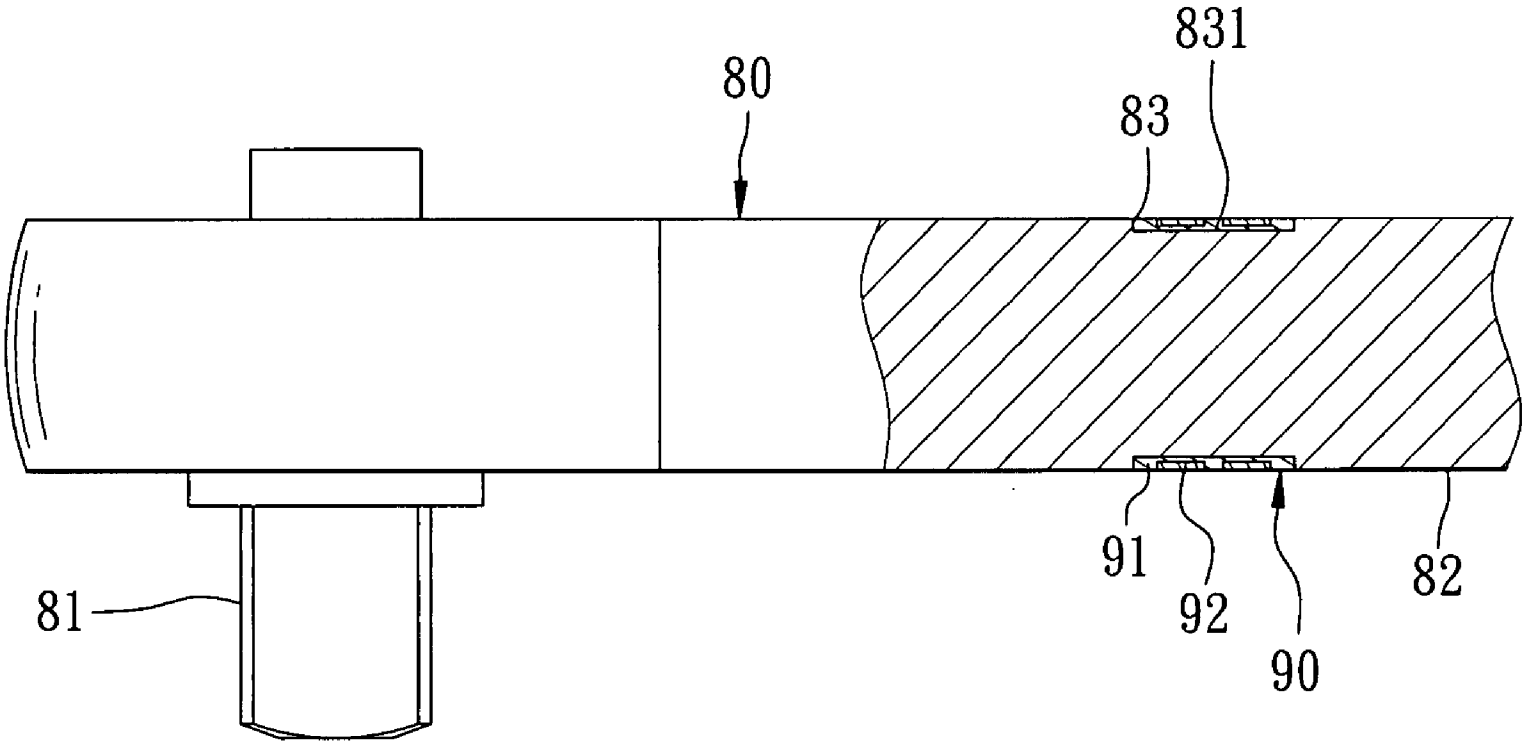
FIG. 7 is a side view of a fourth preferred embodiment of an identification structure of a tool with two colors in the present invention.

As shown in FIG. 7, a third preferred embodiment of an identification structure of a tool with two colors in the present invention has the same components as the first one does. The tool body 80 is a ratchet wrench provided with a working head 81 formed at its front portion for pivotally connecting with a tool. The tool body 80 is also provided with a grip 82 and an engaging surface 83 located in the grip 82, provided with an annular groove 831 concaved on its surface. The identification ring 90 is composed of an inner layer 91 and an outer layer 92 colored differently and overlapped mutually in the annular groove 831 for achieving good distinguishing.

The invention has the following advantages as can be seen from the foresaid description.

1. The inner layer and the outer layer are made of elastic polymer, providing a high friction to keep the inner layer uneasy to loosen from the outer layer and the tool body. And the outer layer can make a user feel softly owing to its elasticity.

2. Although the inner layer and the outer layer are elastic, but they have somewhat a difference in rigidity, enabling them to be mounted on the engaging surface of the tool body tightly.

3. The colors of the inner layer and the outer layer are diverse from each other. The outer layer is installed in the annular groove of the inner layer to have a combination of two different colors, keeping the marks of measurements, specification, metric or imperial systems etc. shown in the marking portion identifiable clearly.

4. The colors of the inner layer and the outer layer are derived from the material, polymer, while they are formed integrally, so the colors never disappear to keep the marking portion identifiable.

5. The tool body can be a grip of a flex wrench or other sort of tools, as long as an annular groove is provided in the surface of the tool body for mounting with the inner layer and the outer layer to provide a clear identification.

While the preferred embodiment of the invention has been described above, it will be recognized and understood that various modifications may be made therein and the appended claims are intended to cover all such modifications that may fall within the spirit and scope of the invention.

What is claimed is:

1. A tool identifier, comprising:

a tool body comprising an engaging surface, an identification ring mounted around the engaging surface, comprising an annular ring shaped inner layer with elasticity comprising an intermediate portion comprising an inner abutment face with at least one projecting portion;

an upper edge adjacent to the intermediate portion, and a lower edge adjacent to the intermediate portion, and wherein the inner layer comprises a first color and a first high molecular polymer, and an annular ring shaped outer layer with elasticity comprising an outer abutment face, a first outer edge, a second outer edge, and an at least one aperture, and wherein the outer layer comprises a second color diverse and easily distinguishable by ordinary human eyesight from the first color, and a second high molecular polymer, and wherein the outer abutment face abuts the inner abutment face, the first outer edge abuts the upper edge, the second outer edge abuts the lower edge, and the at least one projecting portion extends through the at least one aperture.

2. The tool identifier of claim 1, wherein the inner layer and the outer layer are integrally formed; the inner layer is formed before the outer layer and the intermediate portion comprises an annular groove; and the inner layer is placed in a mold and the annular grove is filled with the second molecular polymer to form the outer layer.

3. The tool identifier of claim 2, wherein the first molecular polymer comprises a higher rigidity than the second molecular polymer.

4. The tool identifier of claim 2, wherein the at least one projecting portion comprises a marking portion including at least one of characters, symbols, and drawings.

5. The tool identifier of claim 1, wherein the first molecular polymer comprises a higher rigidity than the second molecular polymer.

6. The tool identifier of claim 1, wherein:

the first color comprises red, and the second color comprises blue.

7. The tool identifier of claim 1, wherein the tool body comprises a sleeve, the sleeve comprising a large waist portion and a small waist portion, and an engaging surface formed around the large waist portion.

8. The tool identifier of claim 1, wherein the tool body comprises a grip, the grip comprising an engaging surface, the engaging surface comprising an annular groove formed around the grip.

9. The tool identifier of claim 1, wherein the first molecular polymer and the second molecular polymer comprise at least one of TPR, TPE, TPU, silicon rubber, rubber, and plastics.

10. The tool identifier of claim 1, wherein the first molecular polymer and the second molecular polymer comprise a high thermal resistance.

11. The tool identifier of claim 1, wherein the at least one projection comprises marks identifying tool parameters comprising measurements and specifications in at least one of the metric system and imperial system.

12. The tool identifier of claim 1, wherein the tool body comprises a sleeve, the sleeve comprising a large waist portion and a small waist portion including an annular groove.

13. A labeled tool, comprising:

a tool element comprising an axis, an outer perimeter of a first dimension and a circumferential groove therein comprising a perimeter of a second dimension less than said first dimension, and comprising parallel sidewalls substantially perpendicular to said axis; and a ring disposed within said groove comprising two parallel edges each confronting a corresponding one of said groove sidewalls, and an inner surface disposed on said groove perimeter, and an outer surface, and comprising an annular identifier wherein said identifier comprises an identifier having apertures therein disposed about said circumference, and wherein said retaining layer extends through said identifier apertures, and a retaining layer engaging said annular identifier, said two parallel edges and said inner surface of said ring, and being disposed in said groove and retained to said tool element.

14. The labeled tool according to claim 13, wherein said apertures having said retaining layer therein are formed to provide at least one of characters, symbols and drawings.

15. The labeled tool according to claim 13, wherein said identifier and said retaining layer extending through said apertures comprise materials having contrasting colors.

16. A labeled tool, comprising:

a tool element comprising an axis, an outer perimeter of a first dimension and a circumferential groove therein comprising a perimeter of a second dimension less than said first dimension, and comprising parallel sidewalls substantially perpendicular to said axis; and a ring disposed within said groove comprising two parallel edges each confronting a corresponding one of said groove sidewalls, and an inner surface disposed on said groove perimeter, and an outer surface, and comprising an annular identifier, and a retaining layer engaging said annular identifier, said two parallel edges and said inner surface of said ring, and being disposed in said groove and retained to said tool element, wherein said annular identifier and said retaining layer comprises rigid materials, and wherein said retaining layer comprises a rigidity lower than said annular identifier rigidity.

17. A labeled tool, comprising:

a tool element comprising an axis, an outer perimeter of a first dimension and a circumferential groove therein comprising a perimeter of a second dimension less than said first dimension, and comprising parallel sidewalls substantially perpendicular to said axis; and a ring disposed within said groove comprising two parallel edges each confronting a corresponding one of said groove sidewalls, and an inner surface disposed on said groove perimeter, and an outer surface, and comprising an annular identifier, and a retaining layer engaging said annular identifier, said two parallel edges and said inner surface of said ring, and being disposed in said groove and retained to said tool element, wherein said retaining layer comprises a moldable material, comprising at least one of TPR, TPE, TPU, silicon rubber, rubber and plastics comprising a high thermal resistance.

* * * * *